United States Patent [19]

Sproul, Sr.

[11] Patent Number: 4,672,887

[45] Date of Patent: Jun. 16, 1987

[54] COMBINATION VALANCE AND CONDITIONED AIR ADMISSION AND RETURN DUCTS

[76] Inventor: Fred C. Sproul, Sr., 1286-129 Discovery St., San Marcos, Calif. 92069

[21] Appl. No.: 726,929

[22] Filed: Apr. 25, 1985

Related U.S. Application Data

[63] Continuation-in-part of Ser. No. 563,090, Dec. 19, 1983, abandoned.

[51] Int. Cl.[4] ..... F24F 3/044

[52] U.S. Cl. ..... 98/31.6; 98/40.05; 98/40.16; 98/41.1; 98/41.3

[58] Field of Search ..... 98/31, 32, 33.1, 34.5, 98/34.6, 31.5, 31.6, 36, 40.01, 40.05, 40.11, 40.16, 41.3

[56] References Cited

U.S. PATENT DOCUMENTS

| | | | |
|---|---|---|---|
| 926,332 | 6/1909 | Hunt | 98/31.6 |
| 2,726,593 | 12/1955 | Lahti | 98/31 |
| 2,811,850 | 11/1957 | Clary | 98/31 X |
| 2,978,779 | 4/1961 | Tatsch | 98/31 X |
| 3,122,087 | 2/1964 | Demuth et al. | 98/40.12 |
| 3,276,348 | 10/1966 | Kennedy | 98/40.16 |
| 3,302,550 | 2/1967 | Thomson | 98/40.16 |
| 3,366,364 | 1/1968 | Curran | 98/31 X |
| 3,394,755 | 7/1968 | Morrison | 98/39.1 |
| 3,511,163 | 5/1970 | Newell et al. | 98/40.12 |
| 3,543,669 | 12/1970 | Kodaras | 98/40.14 |
| 3,576,157 | 4/1971 | Sebald | 98/31 |
| 3,779,150 | 12/1973 | Sproul, Sr. | 98/40.05 |
| 4,168,797 | 9/1979 | Luke | 98/31.6 X |

*Primary Examiner*—Harold Joyce

[57] ABSTRACT

An improved apparatus and method of delivering conditioned air to rooms of a structure or dwelling through ceiling diffusers concealed by a valance and located adjacent the outside walls of the structure is disclosed. Air is delivered to the diffusers by conventional ducting located above the ceiling from a central forced air heating/cooling system and is directed into the room through adjustable apertures in the diffuser in a downwardly direction thereby forming a thermal barrier along the outside wall. Return air is collected at adjustable registers in the floor of the structure which communicate with a network of preformed channels under the flooring and delivered to the central heating or air conditioning system assisted by an auxiliary fan located in the channels.

5 Claims, 9 Drawing Figures

Fig. 4
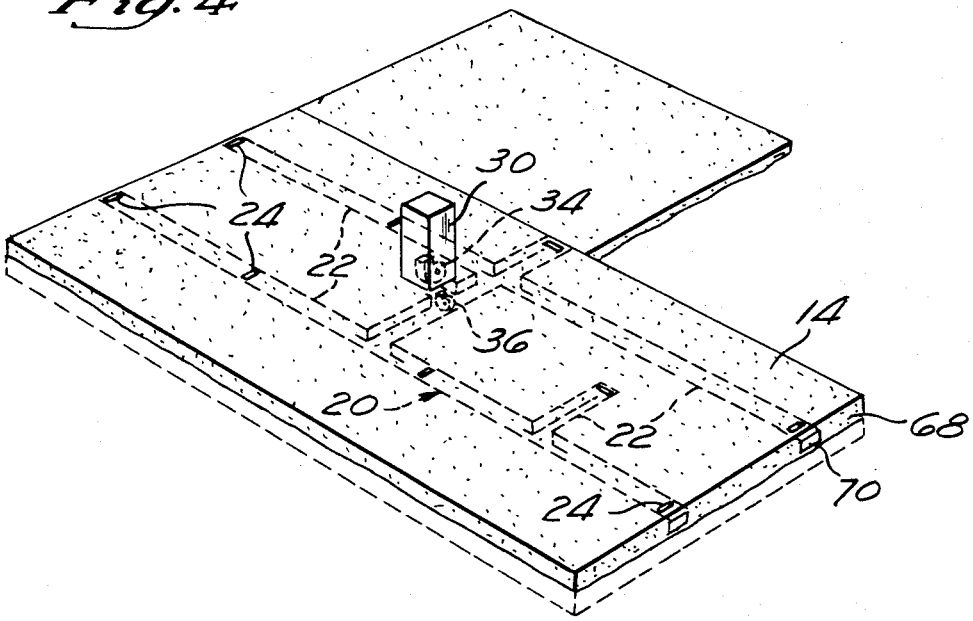
Fig. 5
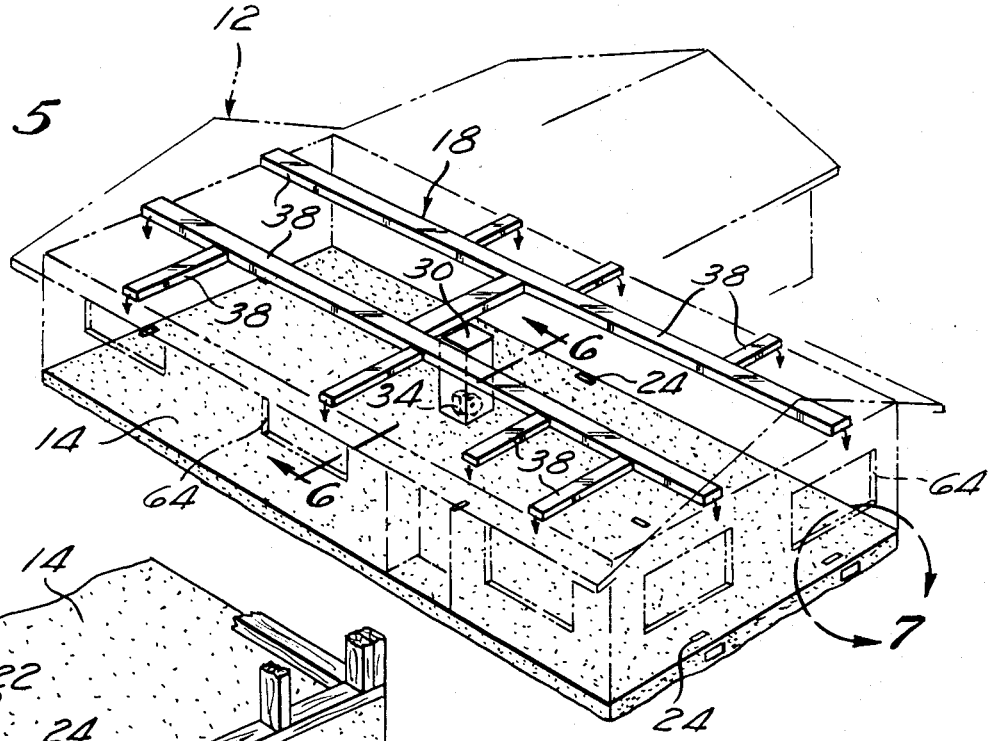
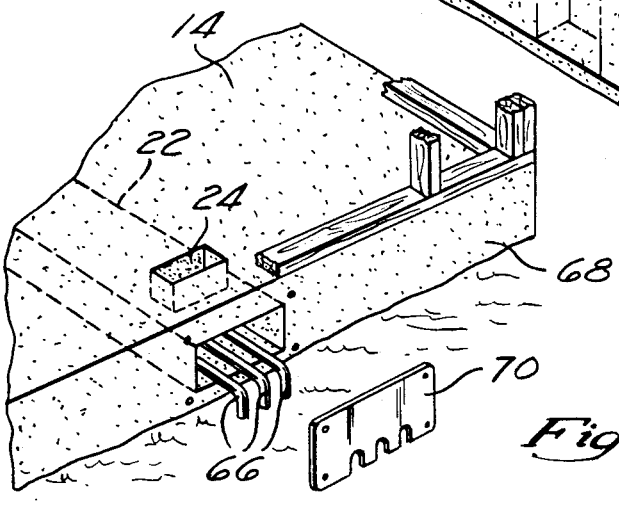
Fig. 7

Fig. 6
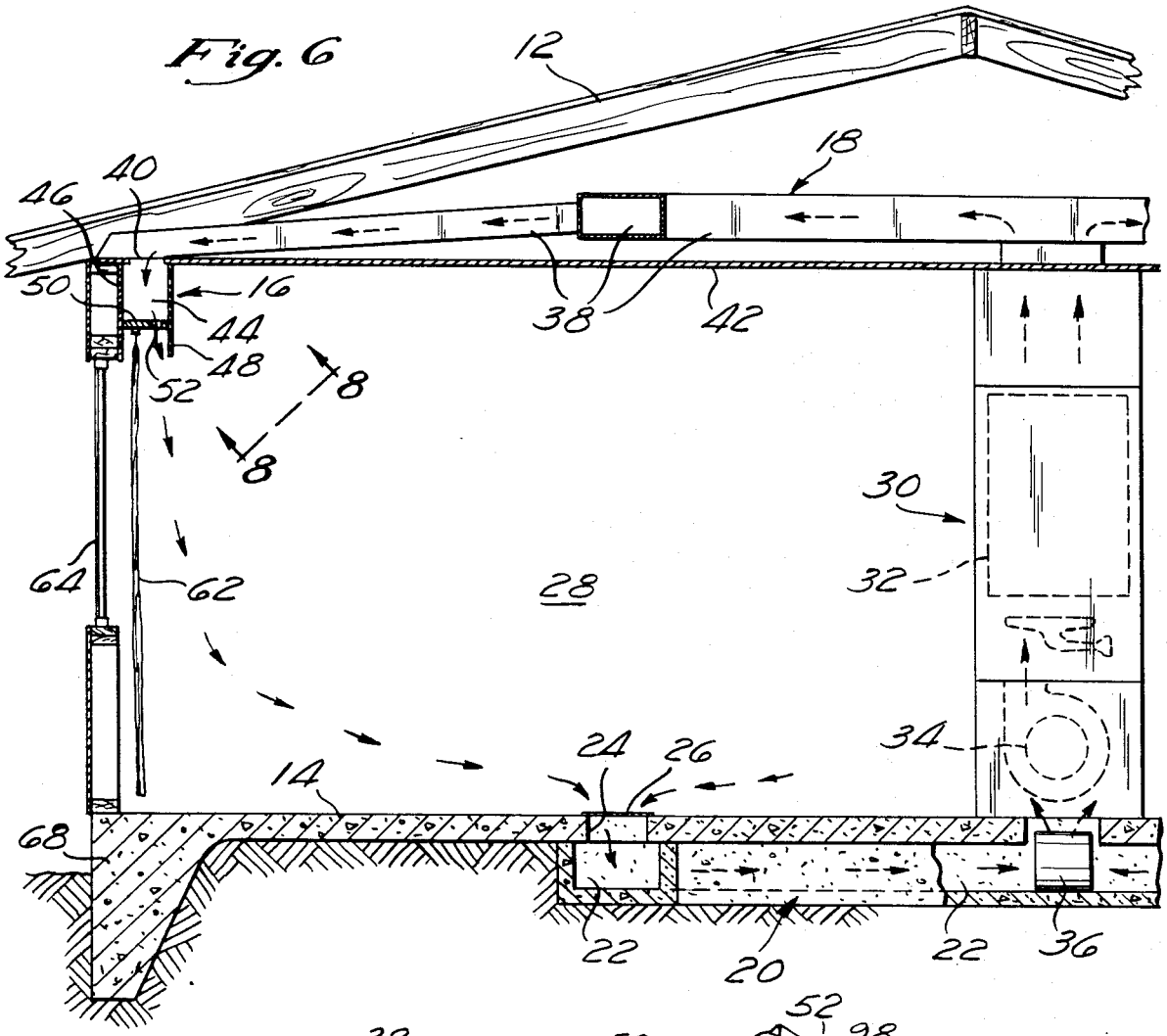
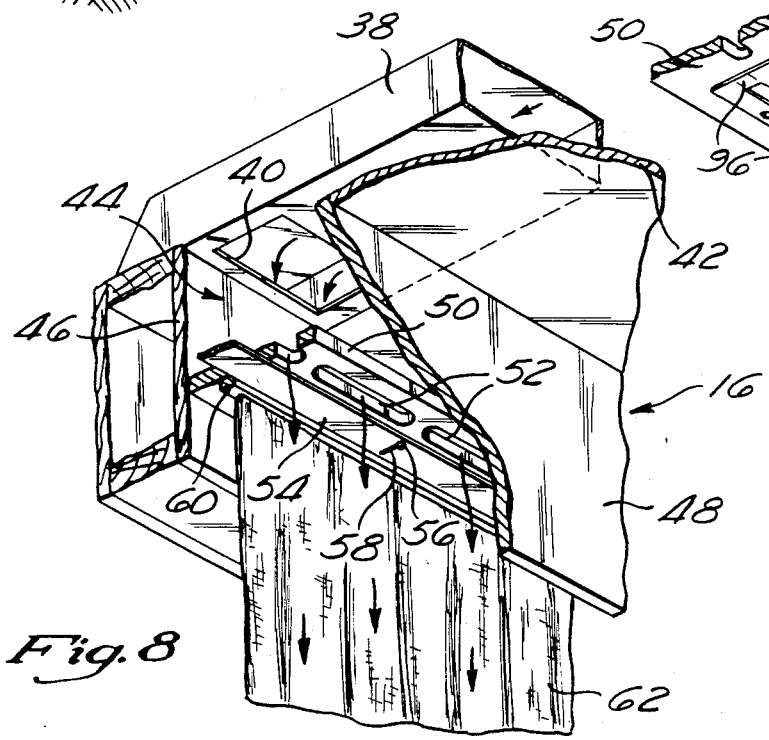
Fig. 8
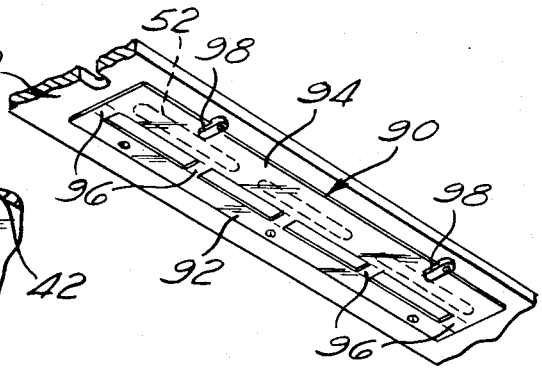
Fig. 9

COMBINATION VALANCE AND CONDITIONED AIR ADMISSION AND RETURN DUCTS

This application is a continuation-in-part of application Ser. No. 563,090, filed Dec. 19, 1983, now abandoned.

BACKGROUND OF THE INVENTION

The subject application is a continuation-in-part application of my copending patent application, Ser. No. 563,090, filed on Dec. 19, 1983 entitled COMBINATION VALANCE AND AIR CONDITIONED AIR ADMISSION AND RETURN DUCTS.

Rooms in structures and dwellings are typically heated by the circulation of heated liquids enclosed within piping systems, the admission of forced heated air through diffusers in a room, or by electrical resistance heating units. Additionally, the rooms are cooled by either an individual air conditioning unit or a central forced air system often combined with the forced air heating system. It has been considered good practice to locate the heat emitters or the forced air diffusers along an outside wall of the room and especially below a window in an outside wall where the temperature inside the room is most likely to be affected adversely by the outside temperature.

The method of circulating centrally heated liquids with associated radiation structures in the rooms has been employed to a considerable extent and is reasonably satisfactory where the structure has a basement or crawl space below the ground floor structure affording access to the piping associated with the heating system. However, with the currently widely used concrete slab which supports the dwelling, the piping is typically embedded in the concrete. Similarly, the plumbing for the houses is frequently embedded as well in the concrete. The serious disadvantage of this technique is that repairs to the system are often very costly.

Dwellings or structures constructed on the concrete slab or a flooring with essentially inaccessible crawl space beneath, are not well suited to perimeter heating at the baseboard level using forced air because the concrete slab or foundation will not readily accommodate air delivery ducts. Thus, the forced air diffusers and collection registers are typically placed in the ceiling with the associated ductwork above the ceiling which results in a less efficient method of heating or cooling a room. In the case where the air diffusers have been placed in the wall, it has not been feasible to locate them strategically relative to windows around sidewalls, because of the logistic problem in running ductwork through the walls. Additionally, diffusers located in the walls and the ceilings seriously detract from the aesthetic appearance of the room.

In the case of structures built on concrete slabs utilizing forced air systems, an additional problem arises in providing air return registers and ducts. Typically, one or several common registers are placed in a centrally located area usually in the ceiling and near the air conditioning unit. Locating the return air registers as such decreases the overall efficiency in the heating or cooling system, decreases the efficiency with which the conditioning of the air in the individual rooms can be controlled, and decreases the exchange rate of air in a room, particularly when both the diffusers and the return registers are located in or near the ceiling.

An improvement to the forced air heating and cooling method has been made by the subject applicant, in U.S. Pat. No. 3,779,150, the disclosure of which is expressly incorporated herein by reference, wherein heated or cooled air is supplied to a plenum or chamber located above a ceiling and in close proximity to an outside wall, typically above an outside window. The plenum chamber is triangularly shaped being formed by the sloped roof and horizontal ceiling on two sides and by a closure panel installed on the third side spanning the space between adjacent joists and rafters in the attic. The plenum generally extends the length of the outside wall and is enclosed on its ends by triangular shaped side panels attached to the outer surfaces of the joists and rafters. The heated or cooled air that is delivered to the plenum is then directed into the room through diffusers located in the ceiling. The diffuser is typically an elongate relatively narrow aperture or series of apertures that are parallel to and extend along the exterior wall of the structure. A valance is provided along the apertures toward the center of the room that serve to both conceal the apertures from view from the room and also to assist in directing the air from the diffusers in a downwardly direction from the ceiling. An additional baffle board between the wall or curtains and the apertures assists in directing the air emerging from the apertures in a downwardly direction and serves to block the flow of air over the top of the drapery and into the space been the drapery and the window. This improvement provides a more efficient way of diffusing heated or cooled air into the room, enhances the comfort of the room by establishing a layer of conditioned air along the exterior wall between the room and the window, and further provides an aesthetically acceptable method of concealing the apertures or diffusers located in the ceiling.

SUMMARY OF THE INVENTION

The present invention is an improved apparatus and method of delivering conditioned air to rooms of a structure or dwelling wherein incoming conditioned air is directed into rooms of the structure through diffusers located adjacent the outside walls of the structure while return air is recirculated through plural channels formed under the flooring of the structure via the aid of an auxiliary forced air fan. The present invention improves on the prior art and more particularly, the applicant's previously patented system, by providing a more simplistic construction of the air duct delivery system to the diffusers located adjacent the ceiling of the dwelling, and providing for an air return system under the flooring of the dwelling to collect the air near the floor surface of the room, thereby increasing the effectiveness and efficiency of the heating or cooling system.

Because of the very prevalent custom of providing the windows on outside walls of dwellings with draperies hung on traverse rods, and of an equally prevalent custom or providing such a drapery with a valance at least as long as the span of the drapery for concealing the rod from which the draperies are suspended, the present invention integrates such a valance with a conditioned air diffusers for the purpose of concealing the air diffuser.

In the preferred embodiment of the invention, the diffuser comprises an elongate rectangular-shaped chamber, preferably positioned adjacent each of the window and door openings of the structure extending at least as long as the span of the drapery or door opening.

The boundaries of the diffuser are defined by the outside wall of the structure and the valance which form its sides, the ceiling forms its top, while an additional planar member extending between the wall and the valance, and spaced below the ceiling, to which the traverse rod of the draperies may be attached forms the bottom surface of the diffuser. A series of elongate relatively narrow apertures are formed in the bottom planar member of the diffuser, and are provided with means by which the quantity of air flow exiting the diffuser may be adjusted. These apertures thereby permit a metered velocity and or quantity of air to flow into the room, thereby insuring against undesirable drafts to be sensed within the rooms of the structure while at the same time providing an effective conditioned air shield, i.e. a thermal barrier or curtain, along a greater portion of the exterior wall to prevent heat loss to the environment. A conventional air supply duct system is additionally disposed within the attic of the structure and is utilized for supplying conditioned air to the chamber from a conventional forced air heating or air conditioning unit.

The novel air return system of the present invention comprises a series of channels that are formed preferably of concrete and directly in the excavation site in relation to concrete slab floor structures prior to forming the flooring of the structure. This network of channels which preferably extends throughout the house resides beneath each room of the structure and is completely covered by the flooring of the structure except at predetermined locations wherein a square or rectangular opening is formed into which a register may be mounted. These registers are preferably strategically and unobstructively positioned within each room to provide for the most efficient collection of air from any particular room.

The channels are interconnected so as to all be in flow communication with a conventional centralized forced air heating/air conditioner unit having a primary air circulation fan or blower disposed therein for circulating air from the channels through the heat exchanger of the forced air unit and subsequently into the air diffusers. To augment air circulation within the system, the present invention incorporates an auxiliary fan disposed within the channels and positioned adjacent to the intake opening of the forced air unit which serves to draw air through the channels and push the same into the forced air unit. Thus, the auxiliary fan forms a "super-charging" effect which has been found to increase system performance.

In addition, both the registers and the air diffusers are provided with an adjustment means for accurately regulating the circulation of the air within the room. Further, the network of channels in the air return system, because of their relative accessibility, can also be used for other purposes, for example, for utility entrances into the structure such as plumbing, electrical conduit, or sewer pipes.

Thus, in summary, the present invention provides a means by which conditioned air can be delivered to concealed ceiling diffusers which distribute the air in a downward direction along an exterior wall and a network of preformed channels under the flooring of the dwelling or structure and further provides an efficient and effective means by which the air can be collected from a room at floor level and delivered to a central heating or air conditioning system assisted by an auxiliary fan located in the channels.

DESCRIPTION OF THE DRAWINGS

These as well as other features of the present invention will become more apparent upon reference to the drawings, wherein:

FIG. 4 is a perspective view of a concrete slab for a dwelling structure showing the air return channels as phantom lines and also depicting the central heating and air conditioning unit with the primary and auxiliary fans;

FIG. 5 is a perspective view of the air delivery system of the present invention;

FIG. 6 is a partial cross-sectional view of a portion of a room, attic, floor, and roof of the structure depicting the central air heating and cooling unit;

FIG. 7 is a perspective view taken at generally about line 7 of FIG. 5; and FIG. 8 is a cut-away view taken generally about the line 8—8 of FIG. 6; and FIG. 9 depicts an additional embodiment of the valance air vent adjustment means of the present invention.

DETAILED DESCRIPTION OF THE PREFERRED EMBODIMENT

Figure 1:
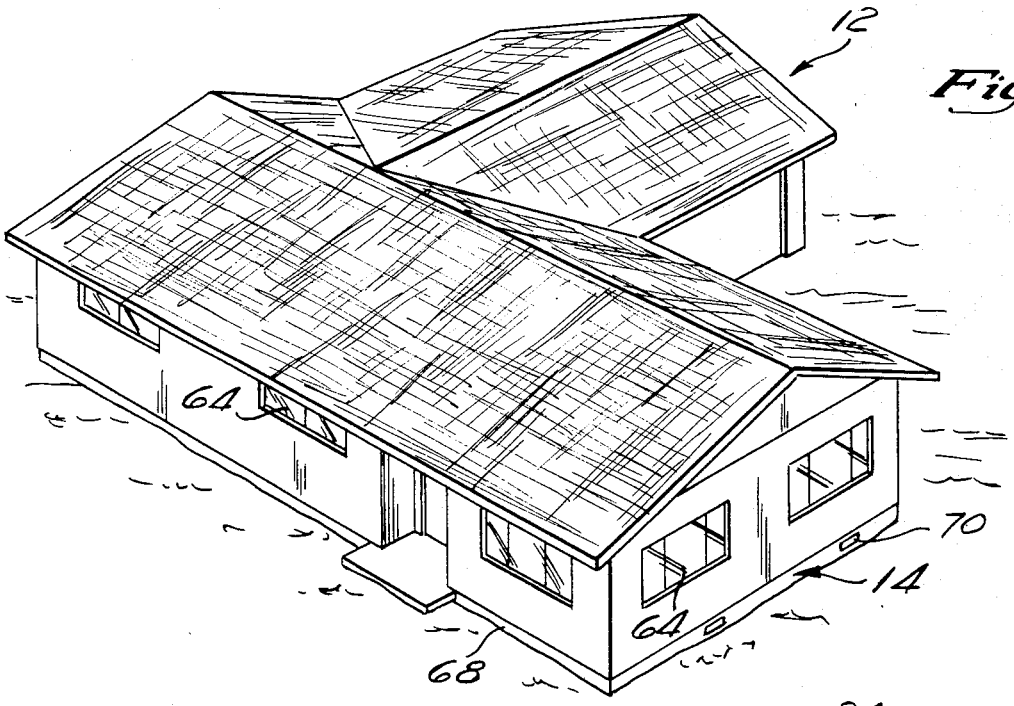
FIG. 1 is a perspective view of a typical dwelling structure utilizing the present invention.
Figure 2:
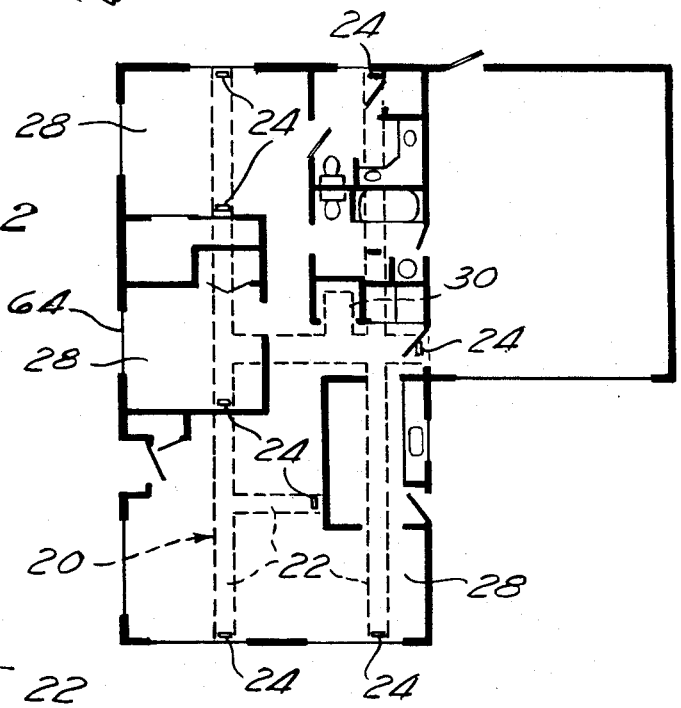
FIG. 2 is a floor plan of the dwelling structure showing the air return channels as phantom lines.
Figure 3:
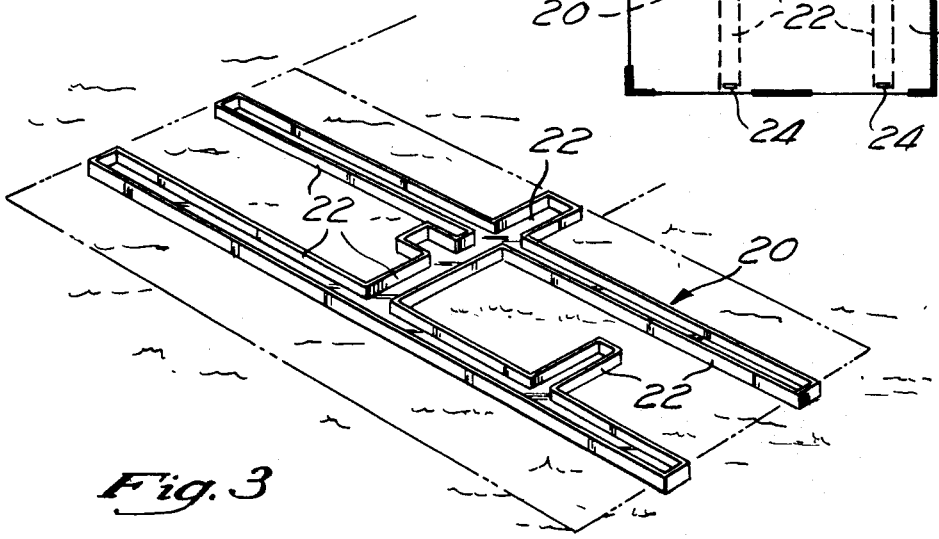
FIG. 3 is a perspective view of a manner of forming the air return channels for use with concrete slab construction techniques.

Referring generally to FIGS. 1 through 6, there is shown a typical dwelling 12 as constructed on a concrete slab floor 14. The invention consists generally of a valance/diffuser air system 16, an air delivery system 18, and an air return system 20. Although the dwelling 12 is shown constructed on a concrete slab 14, other types of floorings to which the invention may be applied are contemplated. Additionally, although the dwelling 12 depicted is a residential house, application of the invention is also contemplated in other types of commerical and noncommercial structures. As such, for purposes of this application, the term dwelling shall be defined to include other types of inhabitable structures while the term concrete slab or flooring shall be defined to include other types of conventional flooring.

The air return system 20 of the present invention is comprised of a network of channels formed preferably from concrete, in trenches that are formed in the excavation site prior to forming the concrete slab 14 of the dwelling 12. A typical network of channels 22 comprising the air return system 20 is clearly illustrated in FIG. 3. Once the air return system 20 has been formed, the individual channels 22 are protected by plywood, foam packing, or the like, and the concrete slab 14 is then poured over the air return system 20. As determined by the specific floor plan of the dwelling 12, provisions are made prior to the pouring of the concrete slab 14 to form square or rectangular openings 24 in the concrete slab 14 to communicate with the individual channels 22 of the air return system 20 and into which a register 26 may be mounted. These registers are preferably strategically and unobstructively positioned to provide each room 28, as dictated by the particular floor plan, with at least one register 26. The registers 26 are further provided with conventional adjusting means by which the air flow through the registers 26 into the air return system 20 can be accurately adjusted.

The air return system 20 directly communicates with a system that heats, cools, or otherwise conditions the air, hereinafter termed the conditioning unit 30, as is shown in FIG. 6. As is well known, the conditioning unit 30 typically comprises a forced air unit having a heat exchanging portion 32 through which air is forced by a conventional blower fan 34 and into the air delivery system 18. The present invention includes an auxiliary fan 36 which forces air into the blower 34, thereby providing a more efficient and uniform return of the air to the conditioning unit 30 from the air return system 20. Although the conditioning unit 30 and the auxiliary fan 36 are shown as being located in a central position with respect to the floor plan of the dwelling 12, as can be more readily seen in FIG. 4, it will be understood that the conditioning unit 30 may be located at any appropriate place in the dwelling 12 and that one or more auxiliary fans 36 may be employed and strategically placed in positions in the air return system 20 to improve the efficiency of the air return system 20.

Referring to FIGS. 5 and 6, returned air that has been conditioned by the conditioning unit 30 is then forced by the blower 34 in to the air delivery system 18. The air delivery system 18 consists of a network of ducts 38, preferably constructed of conventional material, such as aluminum, and configured as directed by the floor plan of a particular dwelling 12 to effectively deliver conditioned air to each room 28 of the dwelling 12. The ducts 38 of the air delivery system 18 transport the conditioned air to the air diffusing system 16 through common apertures 40 in the ducts 38 and the ceiling 42.

Referring to FIG. 8, there is shown a cut-away view of a portion of the air diffusion system 16, which consists of an air diffusion chamber 44 located below and in communication with the apertures 40 in the ceiling 42. The chamber 44 is formed on two sides by the wall 46 and the valance 48, on the top by the lower surface of the ceiling 42, and on the bottom by a closure panel 50 disposed between the wall 46 and the valance 48.

The closure panel 50 is provided with one or more elongate apertures 52 through which the conditioned air may pass under pressure provided by the conditioning unit 30. The closure panel 50 is further provided with a slide plate 54 which extends the length of and is in close contact with the closure panel 50. Since it is desirable to be able to control the amount of air entering a room 28, the position of the slide plate 54 is made adjustable over a portion of the width of the closure panel 50 such that the slide plate 54 acts as a variable closure means for the apertures 52. The adjusting means may comprise several screws 56 threaded into the closure panels 50 through elongate slots 58 in the slide plate 54, or a variety of other means by which the slide plate 54 may be positioned over the apertures 52 to adjust the air flow to the desired amount then secured to the closure panel 50 so that the slide plate 54 will remain in the position to which it has been adjusted.

In FIG. 9, an additional means for adjusting the amount of air entering into the room through the aperture 52 in the closure panel 50 is shown. The additional means comprises an elongate panel 90 formed of a pair of elongate segments 92 and 94 which are laterally interconnected by plural web members 96. The web members 96 as well as preferably the elongate segments 92 and 94 are formed of a plastic resilient material whereby the segments 92 and 94 can be hinged relative one another about the plural webs. The segment 92 is rigidly mounted to the closure 50 in a proximal position to the apertures 52 while the segment 94 is releasably mounted in an overlapping orientation to the apertures 52 by way of one or more manually rotatable lever arms 98. As will be recognized, when it is desired to close off the aperture 52 and thereby discontinue air flow into the room, the segment 94 may be hinged upward and locked in position by the lever arms 98 to completely cover the apertures 52. Conversely, when air flow into the room is desired, the lever arms 98 may be manually removed from contact with the segment 94, and the segment may be hinged downwardly to uncover the aperture 52.

The closure panel 50 may also be provided with a traverse rod 60 from which a drapery 62 may be suspended. The valance 48 extends below the closure panel 50 so that the air diffusing apertures 52 and traverse rod 60 are generally concealed from view except from a viewing point directly below the closure panel 50.

With the structure defined, the method of providing conditioned air to a room 28 with increased efficiency and having enhanced aesthetic appearance and operation may be described. Conditioned air forced into the air delivery system 18 by the blower 34 of the conditioning unit 30 is transported through the apertures 40 in the ceiling 42 to the diffusion chamber 44 of the air diffusing system 16. The air is initially distributed lengthwise along the chamber 44 and then distributed through the apertures 52 in a downwardly direction. The extension of the valance 48 below the closure plate 50 assists in directing the air from the diffusing apertures 52 in a downwardly direction along the outside wall as shown in FIG. 6. Since the outside wall 46 or window 64 represents that area of the dwelling 12 where the maximum difference between the inside and outside temperature is observed, it is within this area that the temperature of the air inside the room 28 is most adversely effected by the outside temperature. To address this problem and to provide a more uniform temperature of the air inside the room 28, the air is purposely directed downwardly in front of the wall 46, window 64, or drapery 62, and is presented such that a thermal barrier is formed by this column of air.

The air from this thermal barrier as well as other air in the room 28 is then drawn through the room and subsequently into one of the registers 26 located in the slab 14 and through the channels 22 of the air return system 20. As will be understood, the air is transported through the channels 22 by the fan 34 of the conditioner 30 assisted or supercharged by the auxiliary fan 36 located within the channel 22. The auxiliary fan 36 thus force-feeds the main blower fan 34 to form a push-pull arrangement which forces the air through the conditioning unit 30 across the heat exchanger 32 and back into the air delivery system 18.

The method of creating the thermal barrier along the outside wall by air diffusing downwardly from the ceiling 42 and subsequently being received by registers 26 located on the floor of the room 28 represents a more efficient means by which the temperature in a room 28 can be controlled and, further, minimizes the drafts being created by conventional systems which force the air in a general direction about the room 28. In addition, by having the auxiliary fan 36 located in the channels 22 under the slab 14 and the main blower fan 34 centrally located, the air movement and the mechanisms by which the air is forcibly moved are essentially inaudible in the rooms 28.

It will be understood by those skilled in the art that there are many ways of implementing the combination air diffusing chamber 44 and the valance 48 within the contemplation of the invention. For example, the air diffusion system 16 may be constructed as a unitary structure that communicates with the apertures 40 in the ceiling 42.

In addition, referring to FIG. 7, the channels 22 of the air return system 20 provide relatively accessible channels 22 through which utilities 66, such as plumbing, electrical conduit and sewer piping may be run. As shown, utilities 66 positioned in the channel 22 of the air return system 20 and directed underground near the foundation 68 of the dwelling 12. Once the utilities 66 are in place, a closure plate 70 is secured against the foundation 68 to provide a seal against the intake of outside air into the air return system 20.

Thus, in summary, the present invention provides a significant improvement in the air circulation system for a dwelling 12 constructed on a concrete slab 14 by delivering conditioned air downwardly along an outside wall 46 from an air diffusion chamber 44 located on the ceiling 42 and concealed by a conventional valance 48. Adjustable apertures 52 in the chamber 44 allow the air flow to be controlled. The conditioned air is returned to the central conditioning system 30 through a network of interconnected channels 22. Additionally, an auxiliary fan 36 is placed in the air return system 20 near the conditioning unit 30 to assist in the more efficient recirculation of the conditioned air. Those skilled in the art will recognize that the present invention may be readily adapted to deliver conditioned air above walls other than outside walls and include other air diffusion chamber 44 designs without departing from the spirit of the present invention.

What is claimed is:

1. An improved air treatment system for a dwelling comprising:

an air diffusion chamber associated with the ceiling and having at least a portion thereof in a position of close proximity to an outer wall of the dwelling;

an opening formed in the chamber facing downwardly in close proximity to the wall and paralleling the wall for venting the chamber to the room;

a conditioning unit having integral fan means for generating a flow of conditioned air to the chamber;

means for conducting the air from the generating means to the chamber;

means for returning the air vented into the room to the air generating means;

a suspended valance member associated with and extending below the chamber for concealment of the opening from view within the room;

an auxiliary fan located in the air returning means to cause the returned air to be drawn through the air returning means and be forced into the integral fan means of the conditioning unit;

said air return means comprising a network of interconnected concrete channels constructed directly in the ground to extend beneath each of the rooms of the structure and be concealed by the floor of the structure; and plural apertures extending through the flooring to communicate with the network of channels, said plural apertures positioned to provide at least one aperture in each of the major rooms of the structure; said network of interconnected channels additionally formed to receive service utilities for said structure.

2. The air treatment system of claim 1 wherein said air return means includes adjusting means to permit metering of air entering said air return means.

3. The air treatment systems of claim 2 wherein said air diffusion chamber includes a suspending means located between said valance member and the wall of the dwelling adapted to provide drapery attachment.

4. The air treatment system of claim 3 wherein said opening in said chamber comprises a series of elongate slots.

5. The air return system of claim 4 wherein the network of channels comprises:

two main channels running parallel to and the length of the flooring;

a plurality of secondary channels perpendicular to and connected to the main channels; and a single channel connecting the two main channels.

* * * * *